US011878824B2

(12) United States Patent
Saitou et al.

(10) Patent No.: US 11,878,824 B2
(45) Date of Patent: Jan. 23, 2024

(54) ELECTRIC WIRE BUNDLING ROBOT

(71) Applicant: Yazaki Corporation, Tokyo (JP)

(72) Inventors: Takahito Saitou, Makinohara (JP); Jun Yagi, Makinohara (JP); Tetsuo Iwao, Susono (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/879,531

(22) Filed: Aug. 2, 2022

(65) Prior Publication Data

US 2023/0041080 A1 Feb. 9, 2023

(30) Foreign Application Priority Data

Aug. 4, 2021 (JP) ..... 2021-128514

(51) Int. Cl.
*B65B 27/10* (2006.01)

(52) U.S. Cl.
CPC ..... *B65B 27/10* (2013.01)

(58) Field of Classification Search
CPC ..... B65B 27/10; B25J 13/08; B25J 15/00; H01B 13/012
See application file for complete search history.

(56) References Cited

FOREIGN PATENT DOCUMENTS

| | | | | |
|---|---|---|---|---|
| JP | 60-212911 A | | 10/1985 | |
| JP | 2017-144501 A | | 8/2017 | |
| JP | 2017144501 A | * | 8/2017 | ..... B25J 15/00 |
| JP | 2018-006309 A | | 1/2018 | |
| JP | 2018-014262 A | | 1/2018 | |
| JP | 2018-144216 A | | 9/2018 | |
| JP | 2018153891 A | * | 10/2018 | ..... B25J 13/08 |

OTHER PUBLICATIONS

Translation of JP-2018153891 (Year: 2018).*
Translation of JP-2017144501 (Year: 2017).*

* cited by examiner

*Primary Examiner* — Bobby Yeonjin Kim
(74) *Attorney, Agent, or Firm* — Sughrue Mion, PLLC

(57) ABSTRACT

A robot hand includes a gripping mechanism. The gripping mechanism includes a pair of gripping claws that perform opening and closing operations in a horizontal direction intersecting with an extending direction of an electric wire. The gripping claw has a lower claw portion that functions as a scooping claw by moving obliquely upward from below. Before or during a bundling operation, a control device of a robot causes the lower claw portion of the gripping claw to move obliquely upward from below to scoop up all electric wires to be bundled.

4 Claims, 13 Drawing Sheets

ELECTRIC WIRE BUNDLING ROBOT

CROSS REFERENCE TO RELATED APPLICATIONS

This application is based on and claims priority from Japanese patent application No. 2021-128514 filed on Aug. 4, 2021, the entire contents of which are incorporated herein by reference.

TECHNICAL FIELD

The present invention relates to an electric wire bundling robot that bundles any plurality of electric wires, among a plurality of electric wires arranged in parallel in a substantially horizontal plane, for binding by tape winding or the like.

BACKGROUND ART

For example, a wire harness of an automobile is manufactured by bundling a plurality of electric wires and subjecting the plurality of electric wires to tape winding or the like. In recent years, a system that performs wire-arranging work by a robot has been developed to meet a demand for efficiency improvement and labor saving.

Patent Literature 1 discloses a technique of bundling a plurality of electric wires in a hanging state. Patent Literature 1 discloses, as a robot hand for performing work on electric wires, a processing robot including a gripping hand for bundling electric wires to a state in which the electric wires can be finally bound, and an auxiliary hand for enclosing scattered electric wires in advance so that the electric wires can be easily bundled before the gripping hand is closed.

In the technique disclosed in Patent Literature 1, it is necessary to provide an auxiliary hand, which is dedicated to enclosing electric wires, separately from the gripping hand, and thus there is a problem that the structure becomes complicated.

In arranging many electric wires to manufacture a wire harness, it is easy to create a well-designed system that deploys the electric wires on a horizontal jig plate. Therefore, a system has been studied in which a robot is installed with respect to a jig plate for routing electric wires in a substantially horizontal plane and routing work is performed by the robot.

However, in a case of arranging electric wires in a horizontal direction to manufacture a wire harness, there is a problem that the electric wires are loosened by its own weights even when tension is applied to the electric wires. Depending on a manufacturing process of the wire harness, the electric wires may be intentionally loosened. Therefore, even when a plurality of electric wires are arranged in parallel at the same height, a height of an electric wire to be bound varies due to a difference in conditions such as a weight and tension of each electric wire.

CITATION LIST

Patent Literature

Patent Literature 1: JP-A-2017-144501

SUMMARY OF INVENTION

Technical Problem

Therefore, even if gripping claws of a robot hand are closed from both sides in an arrangement direction of electric wires, there is a possibility that an electric wire escapes the bundling. As a matter of course, if a size of the gripping claws of the robot hand is increased, the possibility of being able to prevent an electric wire from being left out in the picking-up is increased. In this case, however, the handling performance of the robot hand may deteriorate, and thus the size of the gripping claws cannot be increased too much.

The present invention has been made in view of the above circumstances, and an object of the present invention is to provide an electric wire bundling robot that is capable of simplifying a configuration without providing extra equipment such as an auxiliary hand, and that is capable of enclosing an electric wire to be bound without leaving out the electric wire regardless of a slight positional deviation and bundling and gripping the electric wire even if a size of a gripping claw is not increased too much.

Solution to Problem

An electric wire bundling robot according to an embodiment includes

- a robot arm that is installed in a work space in which a plurality of electric wires are arranged in parallel in a substantially horizontal plane;
- a robot hand that is provided at a tip end of the robot arm and includes a gripping mechanism configured to bundle and grip any plurality of electric wires among the plurality of electric wires by being controlled to any position and posture; and
- a control device that drives and controls the robot arm and the robot hand to cause the gripping mechanism to perform an operation of bundling and gripping the any plurality of electric wires,
- in which the gripping mechanism includes at least a pair of gripping claws that face each other in a horizontal direction intersecting with an extending direction of the electric wires and perform an opening and closing operation, and that bundle and grip the plurality of electric wires by a closing operation,
- in which at least one gripping claw of the pair of gripping claws facing each other has a lower claw portion that functions as a scooping claw by moving obliquely upward from below, and
- in which before or during a bundling operation, the control device drives and controls at least any one of the robot arm and the robot hand to move the lower claw portion of the one gripping claw obliquely upward from below so as to scoop up electric wires to be bundled.

DESCRIPTION OF EMBODIMENTS

Specific embodiments according to the present invention will be described below with reference to the drawings.

Figure 1:
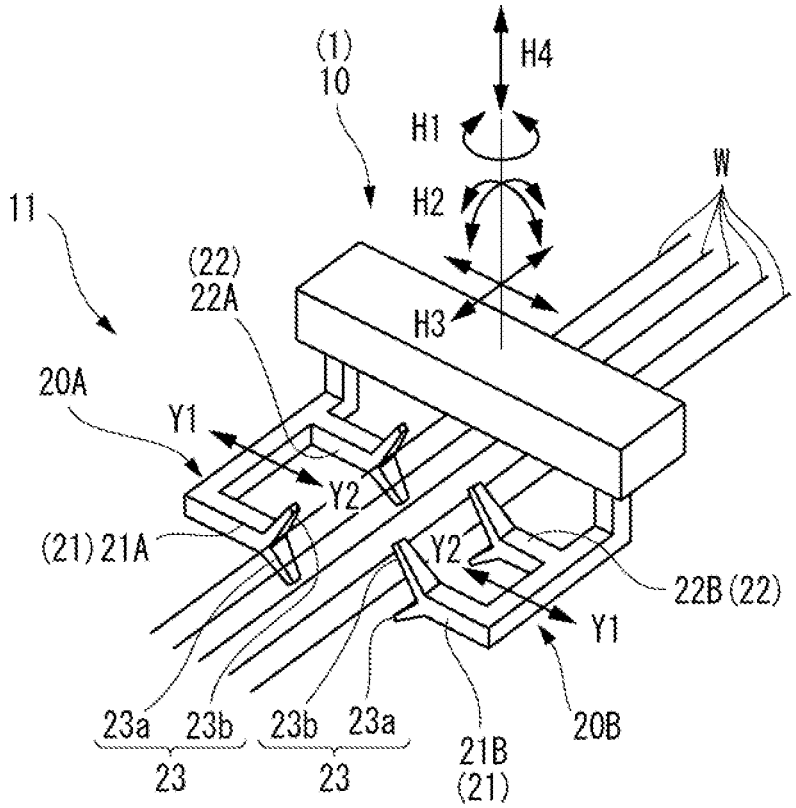
FIG. 1 is a perspective view illustrating a schematic configuration of a robot hand in an electric wire bundling robot according to an embodiment of the present invention.
Figure 2:
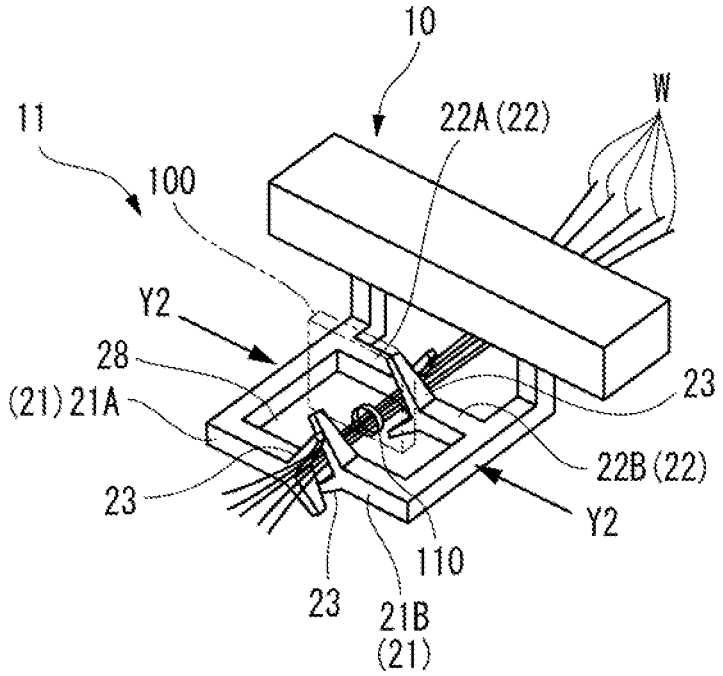
FIG. 2 is a perspective view illustrating a state in which a plurality of electric wires are bundled by closing gripping claws of a gripping mechanism of the robot hand.
Figure 3:
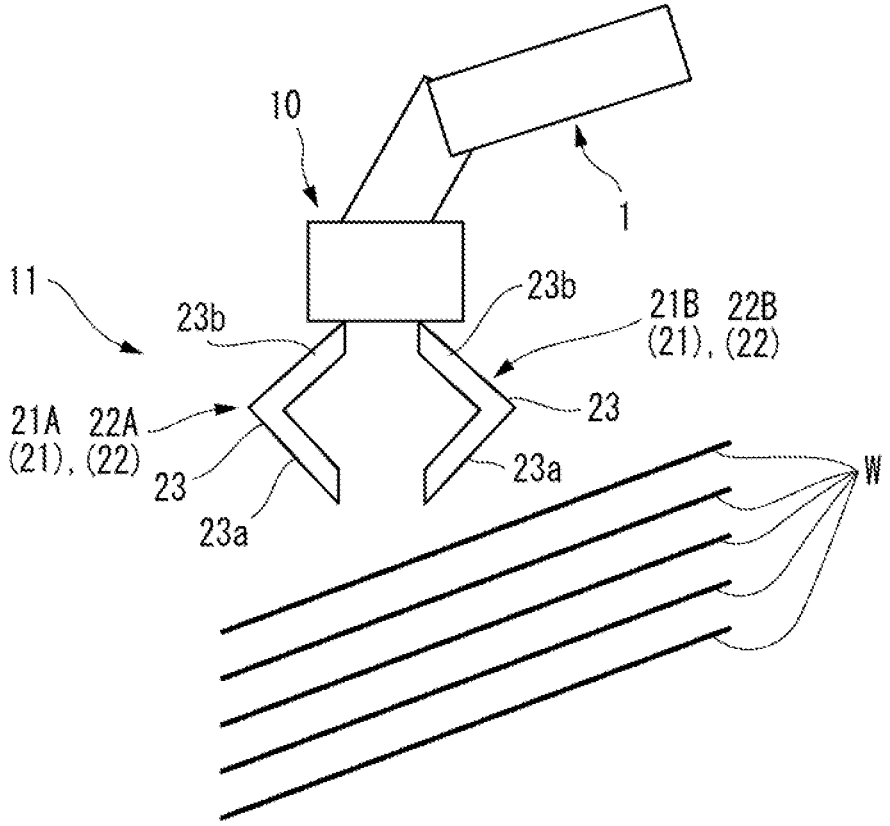
FIG. 3 is a front view schematically illustrating a part of a configuration of the robot hand and a robot arm.
Figure 4:
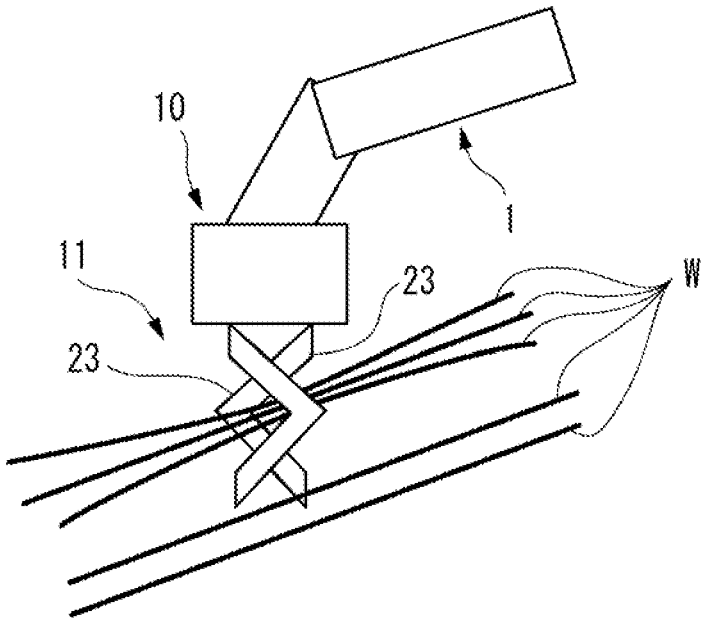
FIG. 4 is a front view illustrating a state in which gripping claws of the gripping mechanism of the robot hand of FIG. 3 are closed to bundle a plurality of electric wires.

FIG. 1 is a perspective view illustrating a schematic configuration of a robot hand of an electric wire bundling robot according to the present embodiment. FIG. 2 is a perspective view illustrating a state in which a plurality of electric wires are bundled by closing gripping claws of a gripping mechanism of the robot hand. FIG. 3 is a front view schematically illustrating a part of a configuration of the robot hand and a robot arm. FIG. 4 is a front view illustrating a state in which the gripping claws of the gripping mechanism of the robot hand of FIG. 3 are closed to bundle a plurality of electric wires.

As illustrated in FIGS. 1 to 4, the electric wire bundling robot of the present embodiment is installed in a work space in which a plurality of electric wires W are arranged in parallel in a substantially horizontal plane, and includes a robot arm 1, a robot hand 10 provided at a tip end of the robot arm 1, and a control device (not illustrated) that drives and controls the robot arm 1, the robot hand 10, and the like.

The robot hand 10 is a portion that bundles and grips a plurality of electric wires W and performs straightening processing on the electric wires W in a gripped state. The robot arm 1 has a configuration in which a plurality of arm portions are coupled to each other via a joint mechanism so as to be rotatable about an axis, and the robot hand 10 is provided at a tip end portion of the robot arm 1. The bundling robot operates the robot arm 1 so as to be able to move the robot hand 10 to any position in any posture with respect to the electric wires W to be bundled. That is, the robot hand 10 can perform multi-axis motion as indicated by arrows H1 to H4 in FIG. 1. As the bundling robot, a rectangular coordinate type robot or the like may be used in addition to a vertical articulated robot using a rotary arm as described above.

Here, the processing of bundling electric wires W refers to processing of gathering a plurality of electric wires W when the plurality of electric wires W are scattered in parallel so that the subsequent gripping and binding processing can be easily performed. In order to perform the processing of bundling electric wires W, the robot hand 10 is provided with a gripping mechanism 11 having gripping claws 23 that can be opened and closed.

The straightening processing on the electric wires W is processing of sliding the robot hand 10 along an extending direction of the electric wires W in a state where the electric wires W are gripped by the gripping mechanism 11. By this processing, curls of the electric wires W can be removed or the electric wires W can be stretched. That is, by straightening the electric wires W before binding the electric wires W, it is possible to prevent the electric wires W from being bound in a state where a part of the electric wires W is bent. Accordingly, the dimensional accuracy can be improved.

In order to perform such straightening processing on electric wires W, the gripping mechanism 11 of the robot hand 10 can grip the electric wires W with a force that allows the sliding. Further, the robot arm 1 can slide the robot hand 10 along the electric wires W.

After the straightening processing, processing is performed in which an adhesive tape is wound around the bundled electric wires W to bind the plurality of electric wires W. In order to perform the binding processing, various configurations including a known tape automatic winding machine may be provided in the robot hand 10 or may be provided separately from the robot hand 10.

Next, the gripping mechanism 11 provided in the robot hand 10 will be described.

The gripping mechanism 11 is provided so as to be able to bundle and grip any plurality of electric wires among a plurality of electric wires by being controlled to any position and posture by the robot hand 10. The control device drives and controls the robot arm 1 and the robot hand 10 to cause the gripping mechanism 11 to perform an operation for bundling or straightening.

The gripping mechanism 11 includes a pair of gripping blocks 20A and 20B that perform opening and closing operations and face each other in a horizontal direction intersecting the extending direction of the electric wires W. In FIG. 1, an arrow Y1 indicates an opening direction, and an arrow Y2 indicates a closing direction. The one gripping block 20A is provided with first and second gripping pieces 21A and 22A separated from each other in the extending direction of the electric wires W. The other gripping block 20B is also provided with first and second gripping pieces 21B and 22B separated from each other in the extending direction of the electric wires W. The gripping claw 23 is provided at a tip end of each of the gripping pieces 21A, 22A, 21B, and 22B.

The gripping claw 23 of the gripping piece 21A of the one gripping block 20A and the gripping claw 23 of the gripping piece 21B of the other gripping block 20B are combined so as to face each other, thereby constituting a first gripping part 21. The gripping claw 23 of the gripping piece 22A of the one gripping block 20A and the gripping claw 23 of the gripping piece 22B of the other gripping block 20B are combined so as to face each other, thereby constituting a second gripping part 22. Accordingly, the first gripping part 21 and the second gripping part 22 are positioned to be separated from each other in the extending direction of the electric wires W.

Since the gripping claw 23 of the one gripping piece 21A of the first gripping part 21 and the gripping claw 23 of the one gripping piece 22A of the second gripping part 22 are provided integrally with the one gripping block 20A, both gripping claws 23 operate integrally with the one gripping block 20A when the one gripping block 20A performs the opening and closing operations. In addition, since the gripping claw 23 of the other gripping piece 21B of the first gripping part 21 and the gripping claw 23 of the other gripping piece 22B of the second gripping part 22 are provided integrally with the other gripping block 20B, both gripping claws 23 operate integrally with the other gripping block 20B when the other gripping block 20B performs the opening and closing operations. Therefore, the first gripping part 21 and the second gripping part 22 simultaneously performs the opening and closing operations when a driving mechanism (not shown) of the gripping mechanism 11 is driven.

Shapes of the gripping blocks 20A and 20B are set such that, when the pair of gripping claws 23 facing each other of the first gripping part 21 and the pair of gripping claws 23 facing each other of the second gripping part 22 are simultaneously closed to bundle the electric wires W, as illustrated in FIG. 2, a work space 28 for tape winding or the like with respect to the bundled electric wires W is secured between the first gripping part 21 and the second gripping part 22.

Each of the pair of gripping claws 23 and 23 facing each other of the first gripping part 21 has a lower claw portion 23*a* directed obliquely downward and an upper claw portion 23*b* directed obliquely upward by providing a V-shaped recess as a space for taking in an electric wire on a surface facing the gripping claw 23 on the other side. The pair of gripping claws 23 are disposed adjacent to each other at positions shifted from each other in the extending direction of the electric wires W. At the time of the closing operation, the lower claw portions 23*a* overlap each other in a shifted state and the upper claw portions 23*b* overlap each other in a shifted state, so that a space around the electric wires W defined by the lower claw portions 23*a* and the upper claw portions 23*b* can be reduced and the electric wires W can be bundled.

The pair of gripping claws 23 and 23 facing each other of the second gripping part 22 also have exactly the same configuration as that of the first gripping part 21. Note that a shifting direction of the positions of the pair of gripping claws 23 and 23, of the first gripping part 21 and the second gripping part 22, for being shifted from each other is arbitrary.

In the example of FIG. 2, the gripping claw 23 (gripping piece 21A) on the left side of the first gripping part 21 in the drawing is on a front side, and the gripping claw 23 (gripping piece 21B) on the right side of the first gripping part 21 in the drawing is on a back side. In addition, the gripping claw 23 (gripping piece 22A) on the left side of the second gripping part 22 in the drawing is on the back side, and the gripping claw 23 (gripping piece 22B) on the right side of the second gripping part 22 in the drawing is on the front side.

By controlling the robot arm 1, the robot hand 10, and the gripping mechanism 11, the control device can cause the gripping claws 23 of the first and second gripping parts 21 and 22 to move freely. In particular, in the present embodiment, when necessary, the control device performs control such that the lower claw portion 23*a* of one of the pair of gripping claws 23 and 23 facing each other can be moved so as to function as a "scooping claw" by moving the one gripping claw 23 obliquely upward from below. A timing of this operation is, for example, before or in the middle of a bundling operation.

Next, the effects will be described.

Figure 5:
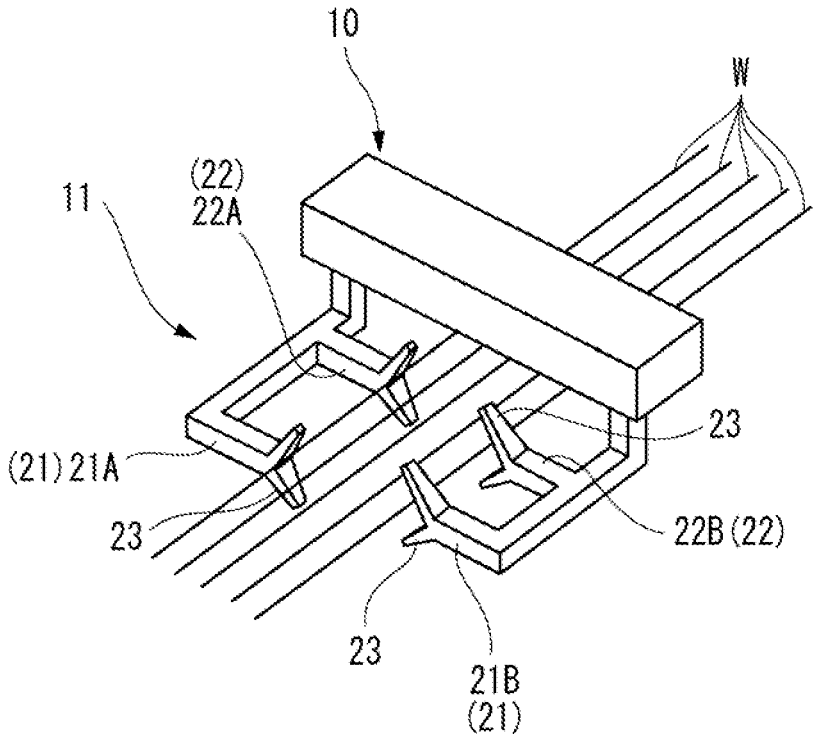
FIG. 5 is a perspective view illustrating a state in which the gripping mechanism of the robot hand is set in an open state and a pair of gripping claws are positioned on both sides of a plurality of electric wires to be bundled so as to sandwich the plurality of electric wires.
Figure 6:
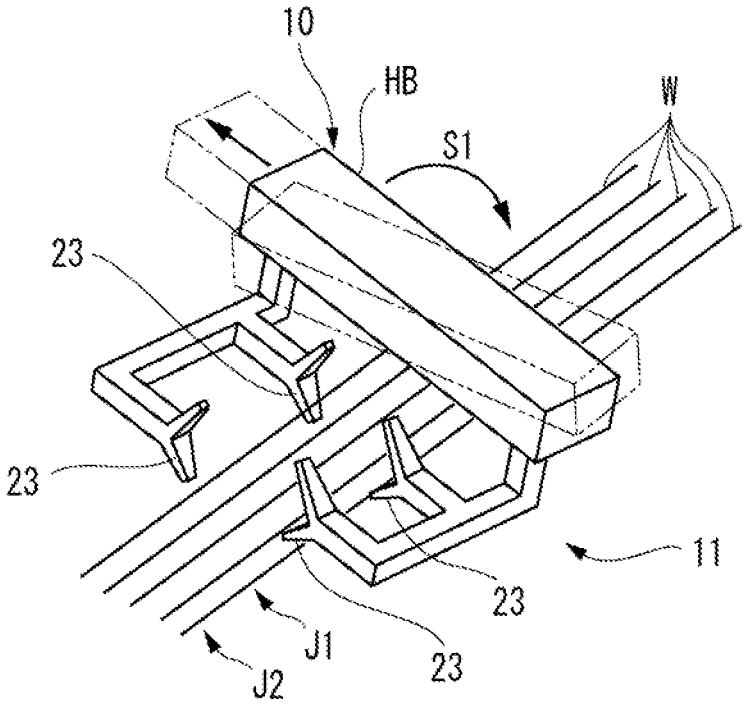
FIG. 6 is a perspective view illustrating a state in which the gripping mechanism of the robot hand is inclined so that a plurality of electric wires to be bundled can be scooped up without any being left out.
Figure 7:
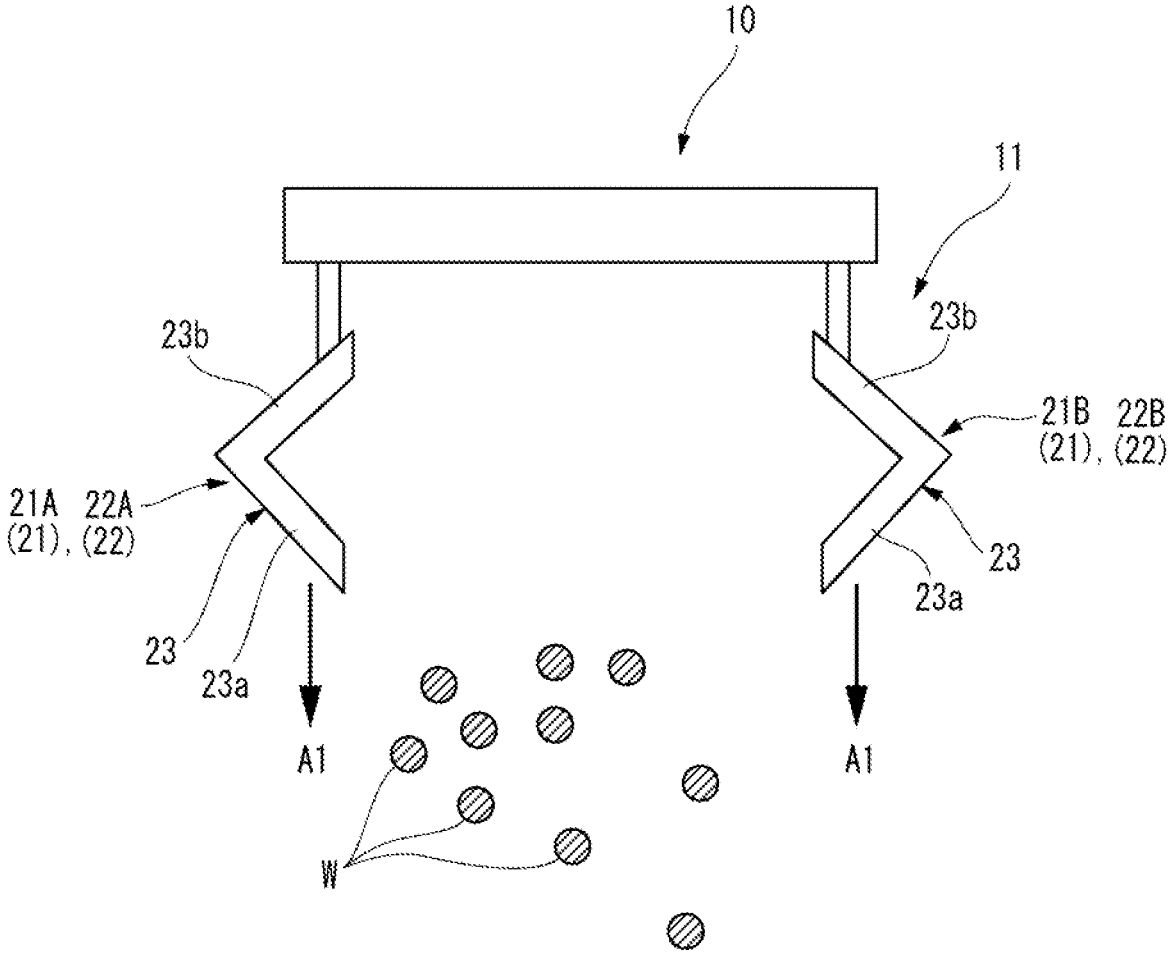
FIG. 7 is a front view illustrating a schematic configuration of the gripping mechanism of the robot hand, and is a view illustrating a state in which a pair of gripping claws are to be set on both sides of a plurality of electric wires to be bundled.
Figure 8:
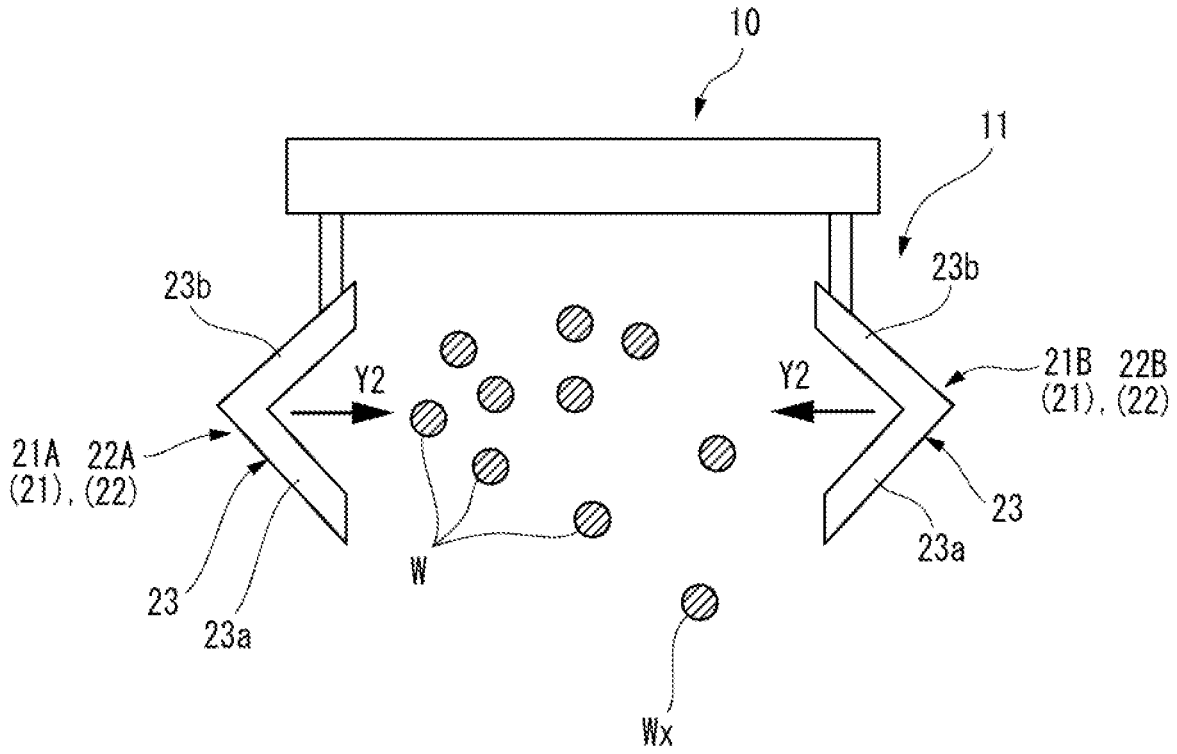
FIG. 8 is a view illustrating that, although gripping claws are set on both sides of a plurality of electric wires to be bundled, there is an electric wire to be left out from enclosure of the electric wires in this state.
Figure 9:
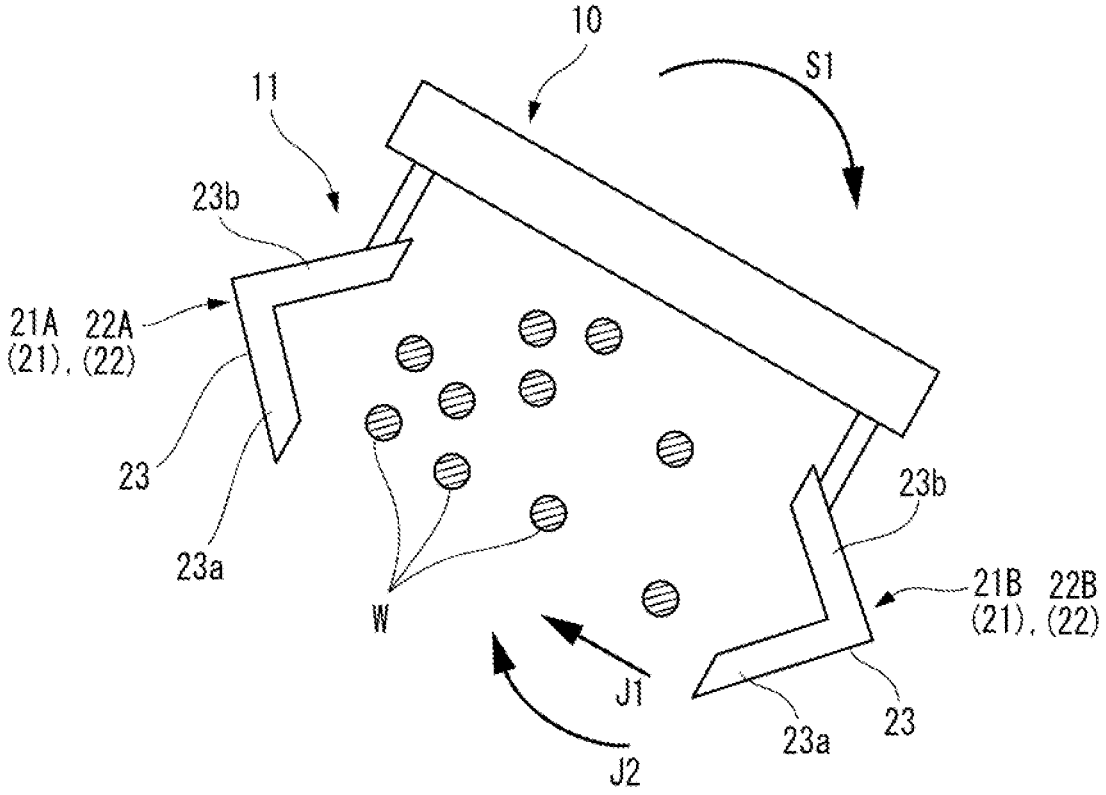
FIG. 9 is a view illustrating a state in which the gripping claws are inclined so as to be able to scoop up the electric wire to be left out from the enclosure in FIG. 8, and a scooping operation is to be performed.

FIG. 5 is a perspective view illustrating a state in which the gripping mechanism 11 of the robot hand 10 is set in an open state and pairs of gripping claws 23 are positioned on both sides of a plurality of electric wires to be bundled so as to sandwich the plurality of electric wires. FIG. 6 is a perspective view illustrating a state in which the gripping mechanism 11 of the robot hand 10 is inclined so that a plurality of electric wires to be bundled can be scooped up without any being left out. Further, FIG. 7 is a front view illustrating a schematic configuration of the gripping mechanism 11 of the robot hand 10, and is a view illustrating a state in which a pair of gripping claws 23 and 23 are to be set on both sides of a plurality of electric wires to be bundled. FIG. 8 is a view illustrating that, although the gripping claws 23 and 23 are set on both sides of the plurality of electric wires to be bundled, there is an electric wire Wx to be left out from enclosure of the electric wires in this state. FIG. 9 is a view illustrating a state in which the gripping claws are inclined so as to be able to scoop up the electric wire to be left out from the enclosure in FIG. 8, and a scooping operation is to be performed.

Figure 10:
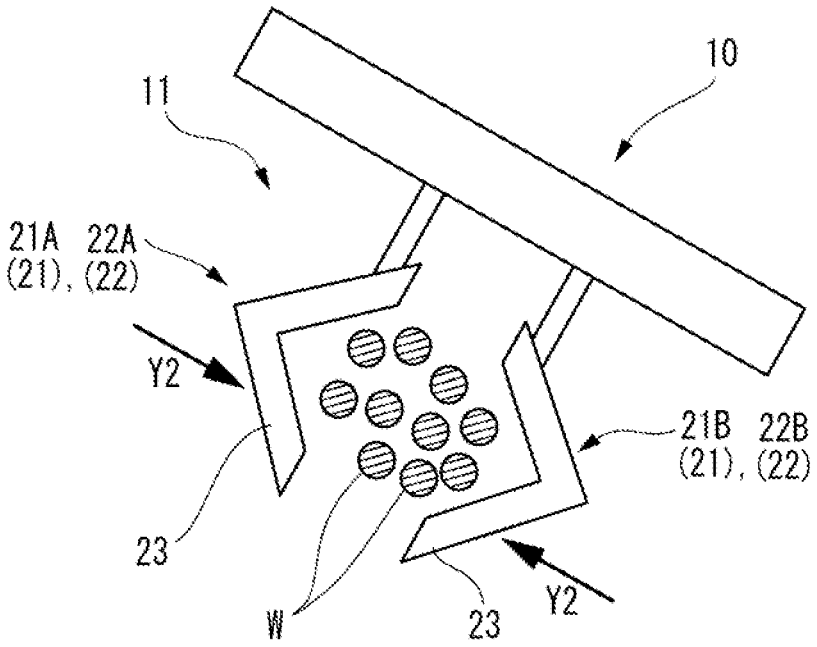
FIG. 10 is a view illustrating a state in which the electric wires are about to be bundled by closing the pair of gripping claws in the scooped-up state.
Figure 11:
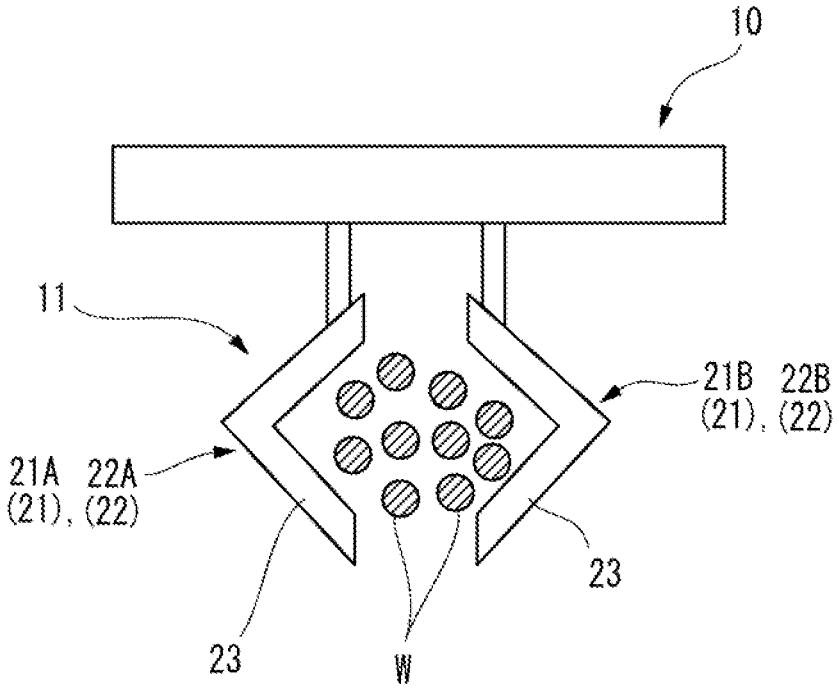
FIG. 11 is a view illustrating a state in which a posture of the gripping mechanism is returned to an original horizontal posture.
Figure 12:
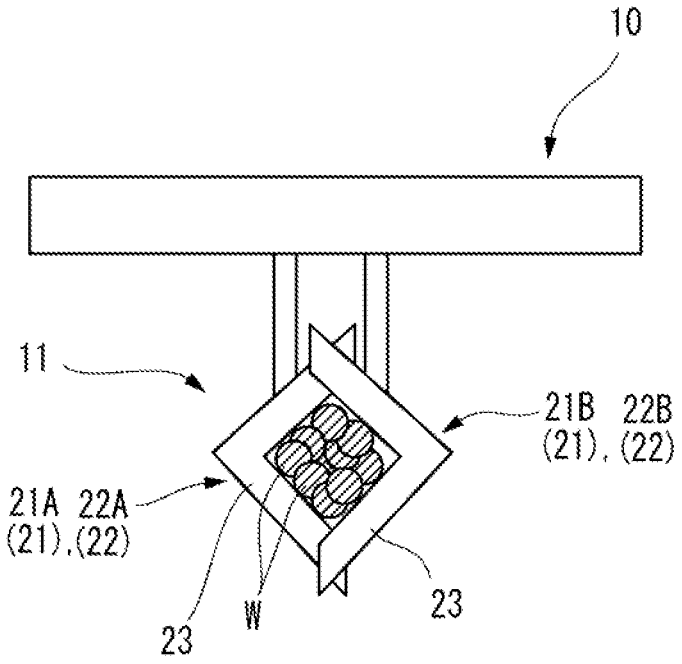
FIG. 12 is a view illustrating a state in which the pair of gripping claws of the gripping mechanism returned to the horizontal posture are closed and all the electric wires to be bundled are bundled without any being left out.

Further, FIG. 10 is a view illustrating a state in which the electric wires are about to be bundled by closing the pair of gripping claws 23 and 23 in the scooped-up state. FIG. 11 is a view illustrating a state in which a posture of the gripping mechanism 11 is returned to an original horizontal posture. FIG. 12 is a view illustrating a state in which the pair of gripping claws 23 and 23 of the gripping mechanism 11 returned to the horizontal posture are closed and all the electric wires W to be bundled are bundled without any being left out.

When performing the bundling operation on the electric wires W, as illustrated in FIGS. 5 to 8, pairs of gripping claws 23 of the gripping mechanism 11 are inserted from above and positioned to positions on both sides in an arrangement direction (horizontal direction) of the plurality of electric wires W to be bundled. At this time, although the gripping claws 23 and 23 are set on both sides of the plurality of electric wires W to be bundled, as illustrated in FIG. 8, even if the gripping claws 23 are closed in this state, the electric wire Wx may be left out from the enclosure with respect to the electric wires W.

When there is such a possibility, the position and posture of the gripping mechanism 11 are controlled, so that the robot hand 10 (gripping mechanism 11) is appropriately inclined or moved as indicated by an arrow S1 in FIG. 6 or FIG. 9, and the electric wire Wx having a possibility of being left out can be scooped up by the lower claw portion 23*a* of the gripping claw 23 that is positioned on the lower side.

Then, as illustrated in FIG. 9, at least any one of the robot arm 1 and the robot hand 10 (including the gripping mechanism 11) is driven and controlled to move the lower claw portion 23*a* of one gripping claw 23 obliquely upward from below so that all the electric wires W to be bundled can be scooped up. The movement may be performed in a linear path as indicated by an arrow J1 in FIG. 9, or may be performed in a curved path as indicated by an arrow J2.

As described above, the lower claw portion 23*a* is moved so that the electric wires W to be bundled can be scooped up without leaving any out, and at the same time or after that, the pair of gripping claws 23 and 23 are to be closed as illustrated in FIG. 10. Then, all the electric wires W to be bundled are enclosed by the pair of gripping claws 23 and 23 without leaving any out. From this state, the gripping mechanism 11 is returned to the original horizontal posture as illustrated in FIG. 11, and the pair of gripping claws 23 and 23 are further closed as illustrated in FIG. 12, whereby the electric wires W can be bundled and gripped as desired.

Next, when it is necessary to straighten the bundled electric wires W, the robot hand 10 is moved relative to the electric wires W in a length direction of the electric wires W in a state where the bundled electric wires W are gripped by the gripping claws 23 and 23, and the electric wires W are straightened to a binding portion. Specifically, in a state where the bundled electric wires W are lightly gripped by the gripping mechanism 11, the robot arm 1 moves the robot hand 10 along the electric wires W to the binding portion. When the electric wires W are straightened to the binding portion in this manner, the electric wires W are in a stretched state. In this state, a binding tape (see reference numeral 110 in FIG. 2) is wound around the electric wires W at the binding portion. Accordingly, the bundled electric wires W are bound at the binding portion.

When binding with the tape, as illustrated in FIG. 2, the work space 28 of a required size is secured between the first gripping part 21 and the second gripping part 22 in a closed state between the pair of gripping blocks 20A and 20B constituting the gripping mechanism 11, and thus the tape winding work can be smoothly performed by inserting a winding head 100 of an automatic tape winding device into the work space 28.

As described above, according to the bundling robot of the present embodiment, the electric wires W to be bundled can be scooped up and bundled without leaving any out by the lower claw portions 23*a* provided in the gripping claws 23 and 23. Therefore, it is less likely to be affected by the number and positions of the electric wires W to be bundled, and it is not necessary to particularly increase the sizes of the gripping claws 23 and 23. In addition, since providing an auxiliary hand separately from a gripping hand (corresponding to the gripping claws 23) as in the related art is not necessary, the structure can be simplified.

In addition, according to the bundling robot of the present embodiment, since the lower claw portion 23*a* and the upper claw portion 23*b* formed by the V-shaped recess are provided in both of the pair of gripping claws 23 and 23, the space around the electric wires W can be reduced in a well-balanced manner during the closing operation of the gripping claws 23 and 23, and the electric wires W can be easily bundled.

In addition, according to the bundling robot of the present embodiment, since the work space 28 for tape winding or the like is secured between the first gripping part 21 and the second gripping part 22, as described above, it is possible to stably perform tape winding while gripping front and rear portions of a tape winding target portion by the first and second gripping parts 21 and 22, and it is possible to improve the tape winding quality.

Although both the pair of gripping claws 23 and 23 are provided with the lower claw portion 23*a* and the upper claw portion 23*b* formed by the V-shaped recess in the above embodiment, the lower claw portion 23*a* and the upper claw portion 23*b* formed by the V-shaped recess may be provided in just one gripping claw 23, and the other gripping claw 23 may be formed in a linear shape extending in an up-down direction.

Figure 13:
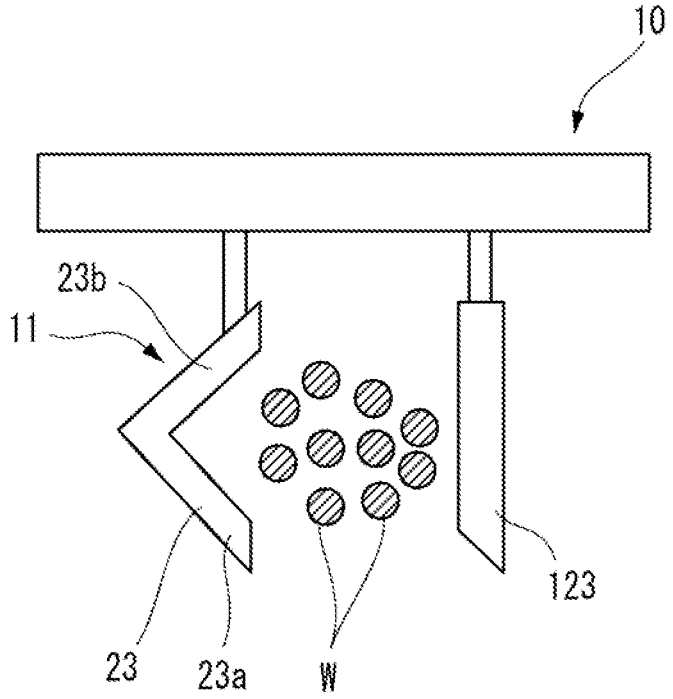
FIG. 13 is a view illustrating a schematic configuration according to another embodiment of the present invention, and is a front view illustrating an example in which one of a pair of gripping claws of a gripping mechanism of a robot hand has a linear shape.

FIG. 13 is a view illustrating a schematic configuration of another embodiment of the present invention, and is a front view illustrating an example in which a single gripping claw 123 of a pair of gripping claws 23 and 123 of the gripping mechanism 11 of the robot hand 10 has a linear shape.

In the present embodiment, the gripping claw 23 of the pair of gripping claws 23 and 123 facing each other has the lower claw portion 23*a* directed obliquely downward and the upper claw portion 23*b* directed obliquely upward by providing a V-shaped recess as a space for taking in electric wires W on a surface facing the gripping claw 123 on the other side.

On the other hand, the other gripping claw 123 of the pair of gripping claws 23 and 123 facing each other is configured as a linear claw portion extending linearly in the up-down direction.

In addition, the pair of gripping claws 23 and 123 are disposed adjacent to each other at positions shifted from each other in an extending direction of the electric wires W. At the time of a closing operation, the lower claw portion 23*a* and the upper claw portion 23*b* of the one gripping claw 23 and the linear claw portion of the other gripping claw 123 overlap in a shifted state, so that a space around the electric wires W defined by the lower claw portion 23*a*, the upper claw portion 23*b*, and the linear claw portion is reduced and the electric wires are bundled.

According to this embodiment, since the one gripping claw 123 is configured as the linear claw portion, a width dimension of the linear claw portion in an arrangement direction of the electric wires W can be reduced. Therefore, even when an interval between the electric wire W and the electric wire W is narrow, the linear claw portion can be easily inserted between the electric wire W and the electric wire W, and a bundling operation can be smoothly performed.

According to the present embodiment, an electric wire bundling robot includes a robot arm (1) that is installed in a work space in which a plurality of electric wires (W) are arranged in parallel in a substantially horizontal plane, a robot hand (10) that is provided at a tip end of the robot arm (1) and includes a gripping mechanism (11) configured to bundle and grip any plurality of electric wires (W) among the plurality of electric wires (W) by being controlled to any position and posture, and a control device that drives and controls the robot arm (1) and the robot hand (10) to cause the gripping mechanism (11) to perform an operation of bundling and gripping the any plurality of electric wires (W), in which the gripping mechanism (11) includes at least a pair of gripping claws (23, 123) that face each other in a horizontal direction intersecting with an extending direction of the electric wires (W) and perform an opening and closing operation, and that bundle and grip the plurality of electric wires (W) by a closing operation, in which at least one gripping claw (23) of the pair of gripping claws (23, 123) facing each other has a lower claw portion (23*a*) that functions as a scooping claw by moving obliquely upward from below, and in which before or during a bundling operation, the control device drives and controls at least any one of the robot arm (1) and the robot hand (10) to move the lower claw portion (23*a*) of the one gripping claw (23) obliquely upward from below so as to scoop up electric wires (W) to be bundled.

According to the electric wire bundling robot having the above configuration, the electric wires to be bundled can be scooped up and bundled, without any being left out, by the lower claw portion provided in the gripping claw. Therefore, it is less likely to be affected by the number and positions of the electric wires to be bundled. Further, providing an auxiliary hand separately from a gripping hand (corresponding to the gripping claw) for enclosing electric wires in advance so that the gripping hand easily bundles the electric wires, as in the related art, is not necessary, and thus the structure can be simplified.

In the electric wire bundling robot, each of the pair of gripping claws (23) facing each other may have the lower claw portion (23*a*) directed obliquely downward and an upper claw portion (23*b*) directed obliquely upward by providing a V-shaped recess as a space for taking in electric wires (W) on a surface facing the gripping claw (23) on the other side, and the pair of gripping claws (23) may be disposed adjacent to each other at positions shifted in an extending direction of the electric wires (W), and at a time of the closing operation, both of the lower claw portions (23*a*) may overlap each other in a shifted state and both of the upper claw portions (23*b*) may overlap each other in a shifted state, so that a space around the electric wires (W) defined by the lower claw portions (23*a*) and the upper claw portions (23*b*) is reduced and the electric wires (W) are bundled.

According to the electric wire bundling robot having the above configuration, since the lower claw portion and the upper claw portion formed by the V-shaped recess are provided in both of the pair of gripping claws, it is possible to reduce the space around the electric wires in a well-balanced manner at the time of the closing operation of the gripping claws, and it is easy to bundle the electric wires.

In the electric wire bundling robot, one of the pair of gripping claws (23, 123) facing each other may have the lower claw portion (23*a*) directed obliquely downward and the upper claw portion (23*b*) directed obliquely upward by providing a V-shaped recess as a space for taking in electric wires (W) on a surface facing the gripping claw (123) on the other side, the other of the pair of gripping claws facing each other may be configured as a linear claw portion (123) extending linearly in an up-down direction, and the pair of gripping claws (23, 123) may be disposed adjacent to each other at positions shifted from each other in an extending direction of the electric wires (W), and at a time of the closing operation, the lower claw portion (23*a*) and the upper claw portion (23*b*) of the one gripping claw (23) and the linear claw portion (123) of the other gripping claw overlap each other in a shifted state, so that a space around the electric wires defined by the lower claw portion (23*a*), the upper claw portion (23*b*), and the linear claw portion (123) is reduced and the electric wires (W) are bundled.

According to the electric wire bundling robot having the above configuration, since one gripping claw is configured as the linear claw portion, a width dimension of the linear claw portion in an arrangement direction of the electric wires W can be reduced.

Therefore, even when an interval between an electric wire and an electric wire is narrow, the linear claw portion can be easily inserted between the electric wire and the electric wire, and the bundling operation can be smoothly performed.

In the electric wire bundling robot, the pair of gripping claws (23) facing each other may include a first gripping claw (23) and a second gripping claw (23) separated from each other in the extending direction of the electric wires (W), and a work space (28) for tape winding or the like on electric wires (W) bundled by closing both gripping claws (23) may be secured between the first gripping claw (23) and the second gripping claw (23).

According to the electric wire bundling robot having the above configuration, since a work space for tape winding or the like is secured between the first gripping claw and the second gripping claw, for example, the tape winding can be stably performed while gripping front and rear portions of a tape winding target portion by the first and second gripping claws, and the tape winding quality can be improved.

According to the present embodiment, the electric wires to be bundled can be scooped up and bundled, without any being left out, by the lower claw portion provided in the gripping claw. Therefore, it is less likely to be affected by the number and positions of the electric wires to be bundled, and it is not necessary to particularly increase sizes of the gripping claws. In addition, since providing an auxiliary hand separately from a gripping hand as in the related art is not necessary, the structure can be simplified.

What is claimed is:

1. An electric wire bundling robot, comprising:

a robot arm that is installed in a work space in which a plurality of electric wires are arranged in parallel in a substantially horizontal plane;

a robot hand that is provided at a tip end of the robot arm and includes a gripping mechanism configured to bundle and grip any plurality of electric wires among the plurality of electric wires by being controlled to any position and posture; and a control device that drives and controls the robot arm and the robot hand to cause the gripping mechanism to perform an operation of bundling and gripping the any plurality of electric wires, wherein the gripping mechanism includes at least a pair of gripping claws that face each other in a horizontal direction intersecting with an extending direction of the electric wires and perform an opening and closing operation, and that bundle and grip the plurality of electric wires by a closing operation, wherein at least one gripping claw of the pair of gripping claws facing each other has a lower claw portion directed obliquely downward and an upper claw portion directed obliquely upward providing a V-shaped recess as a space for taking in electric wires on a surface facing the gripping claw on the other side, the lower claw portion functioning as a scooping claw by moving obliquely upward from below, and wherein before or during a bundling operation, the control device drives and controls at least any one of the robot arm and the robot hand to move the lower claw portion of the one gripping claw obliquely upward from below so as to scoop up electric wires to be bundled.

2. The electric wire bundling robot according to claim 1, wherein each of the pair of gripping claws facing each other has the lower claw portion directed obliquely downward and the upper claw portion directed obliquely upward by providing the V-shaped recess, and wherein the pair of gripping claws are disposed adjacent to each other at positions shifted in the extending direction of the electric wires, and at a time of the closing operation, both of the lower claw portions overlap each other in a shifted state and both of the upper claw portions overlap each other in a shifted state, so that a space around the electric wires defined by the lower claw portions and the upper claw portions is reduced and the electric wires are bundled.

3. The electric wire bundling robot according to claim 1, wherein one of the pair of gripping claws has the lower claw portion directed obliquely downward and the upper claw portion, wherein the other of the pair of gripping claws facing each other is configured as a linear claw portion extending linearly in an up-down direction, and wherein the pair of gripping claws are disposed adjacent to each other at positions shifted from each other in an extending direction of the electric wires, and at a time of the closing operation, the lower claw portion and the upper claw portion of the one gripping claw and the linear claw portion of the other gripping claw overlap each other in a shifted state, so that a space around the electric wires defined by the lower claw portion, the upper claw portion, and the linear claw portion is reduced and the electric wires are bundled.

4. The electric wire bundling robot according to claim 1, wherein the pair of gripping claws facing each other include a first gripping claw and a second gripping claw separated from each other in the extending direction of the electric wires, and a work space for tape winding or the like on electric wires bundled by closing both gripping claws is secured between the first gripping claw and the second gripping claw.

* * * * *